US007530928B2

(12) United States Patent
Liao

(10) Patent No.: US 7,530,928 B2
(45) Date of Patent: May 12, 2009

(54) STEPPING EXERCISER

(75) Inventor: Hsueh-Hu Liao, Guangdong Province (CN)

(73) Assignee: HL Corp (Shen Zhen), Shenzhen (CN)

( * ) Notice: Subject to any disclaimer, the term of this patent is extended or adjusted under 35 U.S.C. 154(b) by 235 days.

(21) Appl. No.: 11/551,265

(22) Filed: Oct. 20, 2006

(65) Prior Publication Data

US 2007/0232458 A1 Oct. 4, 2007

(30) Foreign Application Priority Data

Apr. 4, 2006 (CN) ..... 2006 2 0057517 U

(51) Int. Cl.
*A63B 22/04* (2006.01)

(52) U.S. Cl. ..... 482/53

(58) Field of Classification Search ..... 482/51–53, 482/57, 121–124

See application file for complete search history.

(56) References Cited

U.S. PATENT DOCUMENTS

| | | | | |
|---|---|---|---|---|
| 5,752,901 | A * | 5/1998 | Lee | 482/130 |
| 6,595,899 | B2 * | 7/2003 | Liang | 482/53 |
| 6,709,367 | B1 * | 3/2004 | Liang | 482/53 |
| 6,712,739 | B1 * | 3/2004 | Chen | 482/53 |
| 6,997,854 | B2 * | 2/2006 | Yang | 482/53 |
| 7,044,899 | B2 * | 5/2006 | Kuo | 482/121 |
| 2005/0209058 | A1 * | 9/2005 | Yu | 482/52 |
| 2006/0199703 | A1 * | 9/2006 | Shifferaw | 482/52 |

* cited by examiner

*Primary Examiner*—Steve R Crow

(57) ABSTRACT

A stepping exerciser includes a bracket, a rack, a pair of pedal holders rotatably mounted to an upper portion of the bracket, a pair of pedal holders rotatably mounted to an upper portion of the bracket, a pair of pedals, a beam pivoting the bracket to an upper portion of the rack, a pair of connecting levers respectively rotatably connected between the pedals and the rack, a pair of wheels and a pair of flexible pulling members. The wheels are rotatably installed on the rack. Each flexible pulling member is pivoted at one end thereof to the beam and at the other end thereof to a lower portion of the pedal holders. The flexible pulling members installed between the beam and the pedal holders enhance movement resistance to the pedals, for efficiently exercising multiple parts of a user.

11 Claims, 3 Drawing Sheets

STEPPING EXERCISER

BACKGROUND OF THE INVENTION

1. Field of the Invention

The present invention relates to an apparatus to take exercise, and more particularly to a stepping exerciser which has multiple functions.

2. Description of Related Art

Currently stepping exercisers are mainly classified into two kinds. One kind of them has a very simple structure and merely conduct swaying exercises. The kind of stepping exercisers merely exercises the legs of a user. The other kind of them operates by means of one or more oil cylinders to apply a resistive force against the pedals. However, the kind stepping exercisers have complex structure and are too expensive to be widespread applied in common families.

SUMMARY

Accordingly, what is needed is a stepping exerciser which has multiple functions and can efficiently exercise multiple parts of a user.

A stepping exerciser includes a bracket, a rack, a pair of pedal holders rotatably mounted to an upper portion of the bracket, a pair of pedal holders rotatably mounted to an upper portion of the bracket, a pair of pedals, a beam pivoting the bracket to an upper portion of the rack, a pair of connecting levers respectively rotatably connected between the pedals and the rack, a pair of wheels and a pair of flexible pulling members. The wheels are rotatably installed on the rack. Each flexible pulling member is pivoted at one end thereof to the beam and at the other end thereof to a lower portion of the pedal holders. The flexible pulling members installed between the beam and the pedal holders enhance movement resistance to the pedals, for efficiently exercising multiple parts of a user. An amount of the flexible pulling members can also be changed to regulate the resistance to the pedals, for meeting requirement of different user.

Other advantages and novel features of the present invention will become more apparent from the following detailed description when taken in conjunction with the accompanying drawings, in which:

DETAILED DESCRIPTION OF THE EMBODIMENTS

Figure 1:
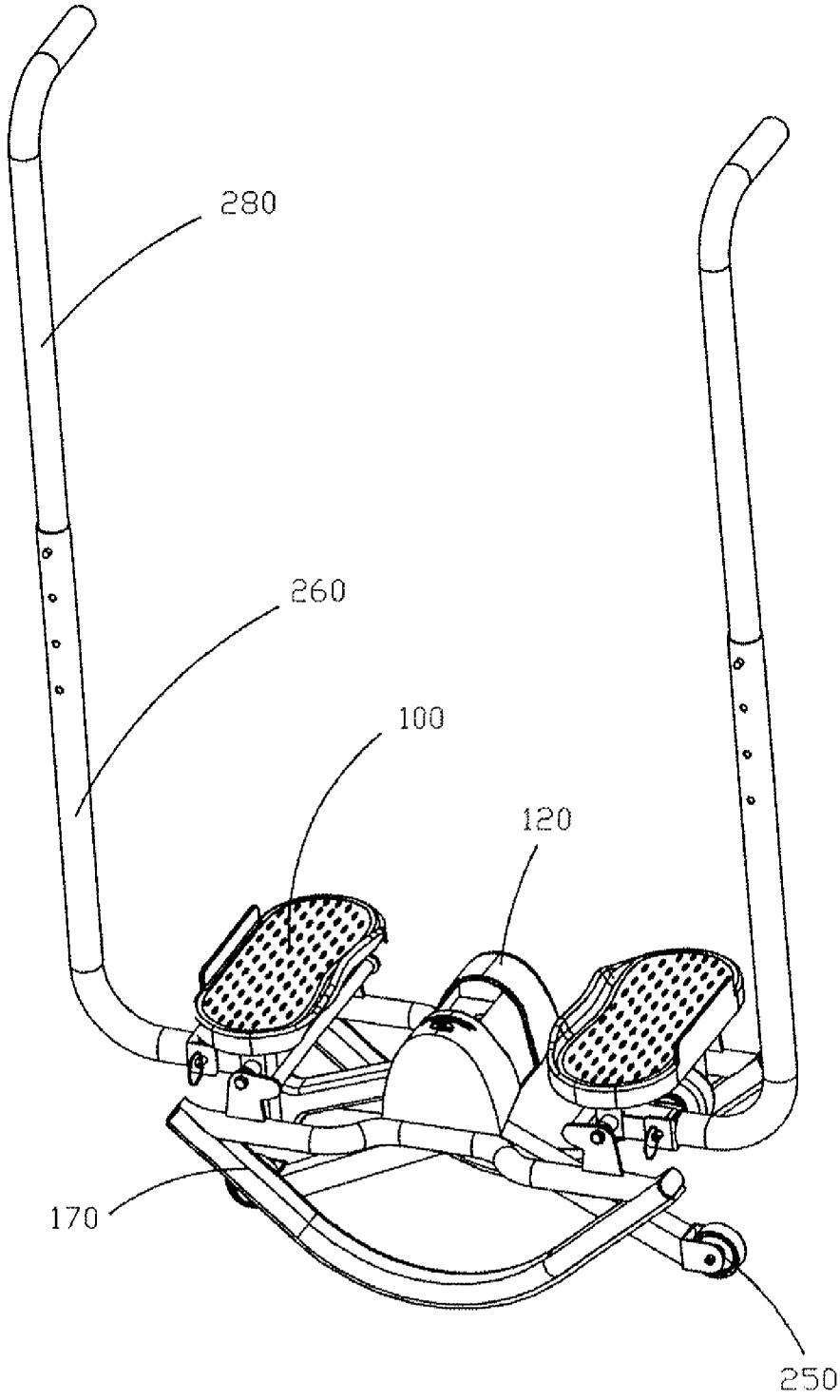
FIG. 1 is an assembled, isometric view of a stepping exerciser in accordance with an embodiment of the present invention.
Figure 2:
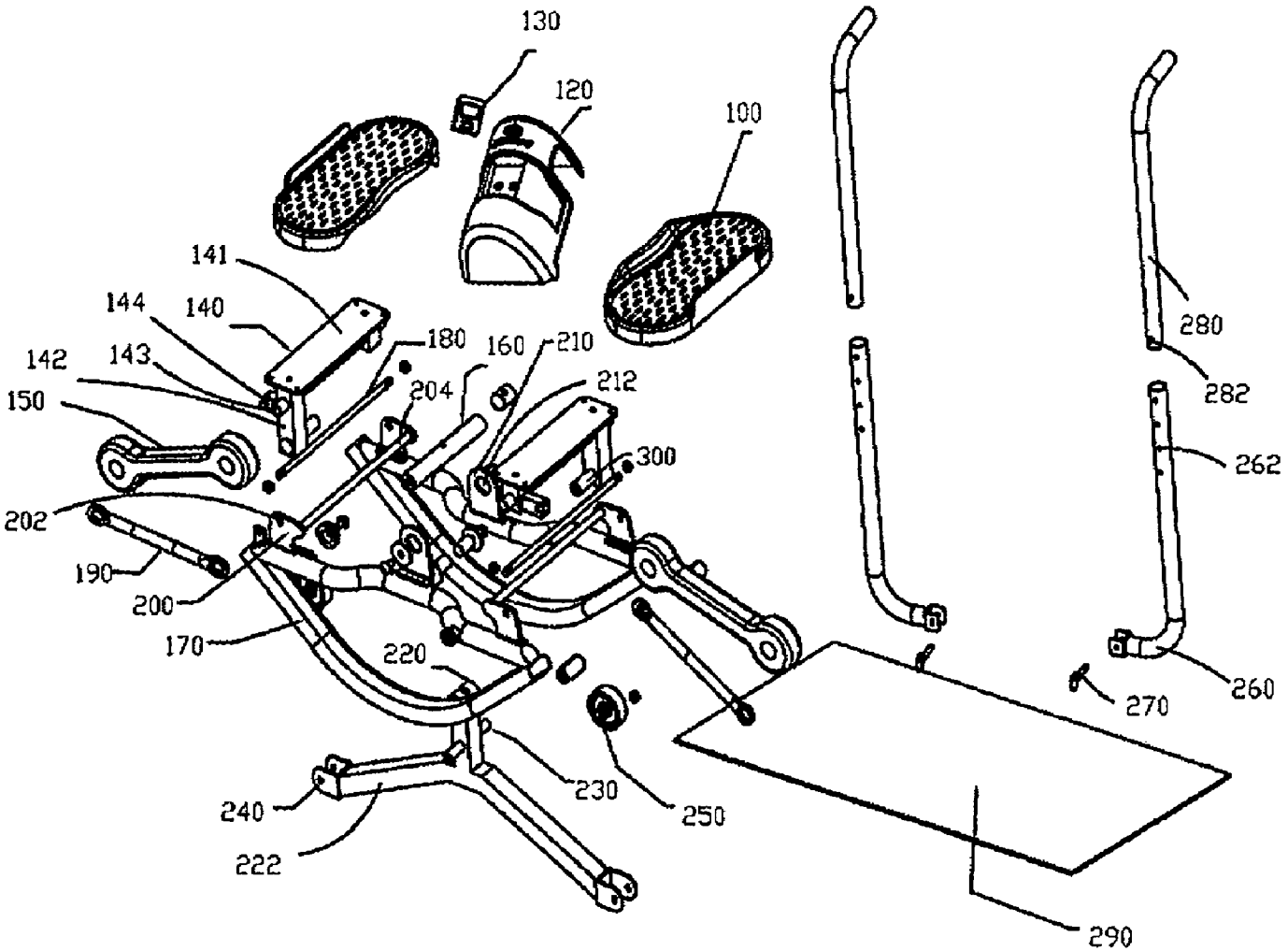
FIG. 2 is an exploded view of FIG. 1.

Referring to FIG. 1 to FIG. 2, an exemplary embodiment of a stepping exerciser comprises a bracket 170, a V-shaped rack 220, a pair of flexible pulling members 150, a pair of pedals 100, a beam 160, a pair of connecting levers 190, a pair of pedal holders 140, two rotating rods 180, a pair of wheels 250, a shell 120, two L-shaped pipes 260, two handles 280 and a carpet 290.

The bracket 170 comprises two L-shaped plates 210 at a center thereof and two groups of tabs 200 respectively adjacent opposite ends thereof. Each plate 210 defines an installing hole 212 therein, for installing the beam 160 between the plates 210. Each tab 200 defines a through hole 202 adjacent to an outer side thereof. Each group of tabs 200 is connected by a limiting member 204 at an inner side thereof.

The rack 220 comprises two supporting legs 222 at a lower portion thereof. Each support leg 222 has a U-shaped engaging portion 240 at a distal end thereof. The wheels 250 are mounted to the engaging portions 240 respectively. The stepping exerciser smoothly moves on the flow by means of the wheels 250. A double end nut 230 having inner thread at opposite ends thereof, is provided to a center of the rack 220.

The beam 160 is installed to the bracket 170 via two opposite ends thereof engaging in the installing holes 212 of the plates 210. A center of the beam 160 is rotatably extended through an upper portion of the rack 220.

The pedal holders 140 each comprises a mount 141 for the corresponding pedal 100 being mounted thereon, a connecting portion 142 extending downwardly from the mount 141. Each rotating rod 180 can pass through the through hole 202 of one tab 200 of the bracket 170 and a hollow tube 143 extending through the connecting portion 142 of a corresponding pedal holder 140. Opposite ends of each rotating rod 180 are engaged with nuts (not labeled), in order to rotatably install the corresponding pedal holder 140 to the bracket 170. A positioning nut 300 extends perpendicularly and inwardly from the connecting portion 142 of each pedal holder 140. One end of each connecting lever 190 is rotatably connected to the positioning nut 300, and the other end of the connecting lever 190 is rotatably connected to one end of the double end nut 230. An outer positioning protrusion 144 extends outwardly from the connecting portion 142 of each pedal holder 140.

Each flexible pulling member 150 is pivoted at one end thereof to the beam 160, and at an opposite end thereof to the positioning nut 300 of the corresponding pedal holder 140.

The pedal holders and the L-shaped pipes 260 are positioned to the positioning protrusions 144 by means of pegs 270. The handles 280 are respectively positioned into the L-shaped pipes 260 via copper pins. Each L-shaped pipe 260 defines a plurality of locating holes 262 at an upper portion thereof. Each handle 280 defines a locating portion 282 adjacent a bottom end thereof. The locating portion 282 are selectively locked at different locating holes 262 by the copper pins to allow a height of each hanndle 280 to be adjustable in accordance with different users.

In use of the stepping exerciser, the pedals 100 rotate inwardly and outwardly, according to a movement of the pedal holders 140. The limiting members 204 of the bracket 170 limit the rotation range of the pedal holders 140. When the pedals 100 are rotated to a predetermined location, the pedal holders 140 are prevented by the limiting members 204 from continuing moving to an undesired location.

The shell 120 is placed above the beam 160 and the plates 210 for shading them. A counter 130 is employed in the stepping exerciser to measure the stepping time. The counter 130 can be any conventional counter.

In the embodiment, the flexible pulling members 150 are installed between the beam 160 and the pedal holders 140, for enhancing movement resistance to the pedals 100, for efficiently exercising multiple parts of a user. An amount of the flexible pulling members 105 can be changed to regulate the resistance to the pedals 100, for meeting requirement of different user. Thus, the stepping exerciser can be widespread applied in common families.

The carpet 290 is placed on the floor, for supporting the rack 220 thereon.

Figure 3:
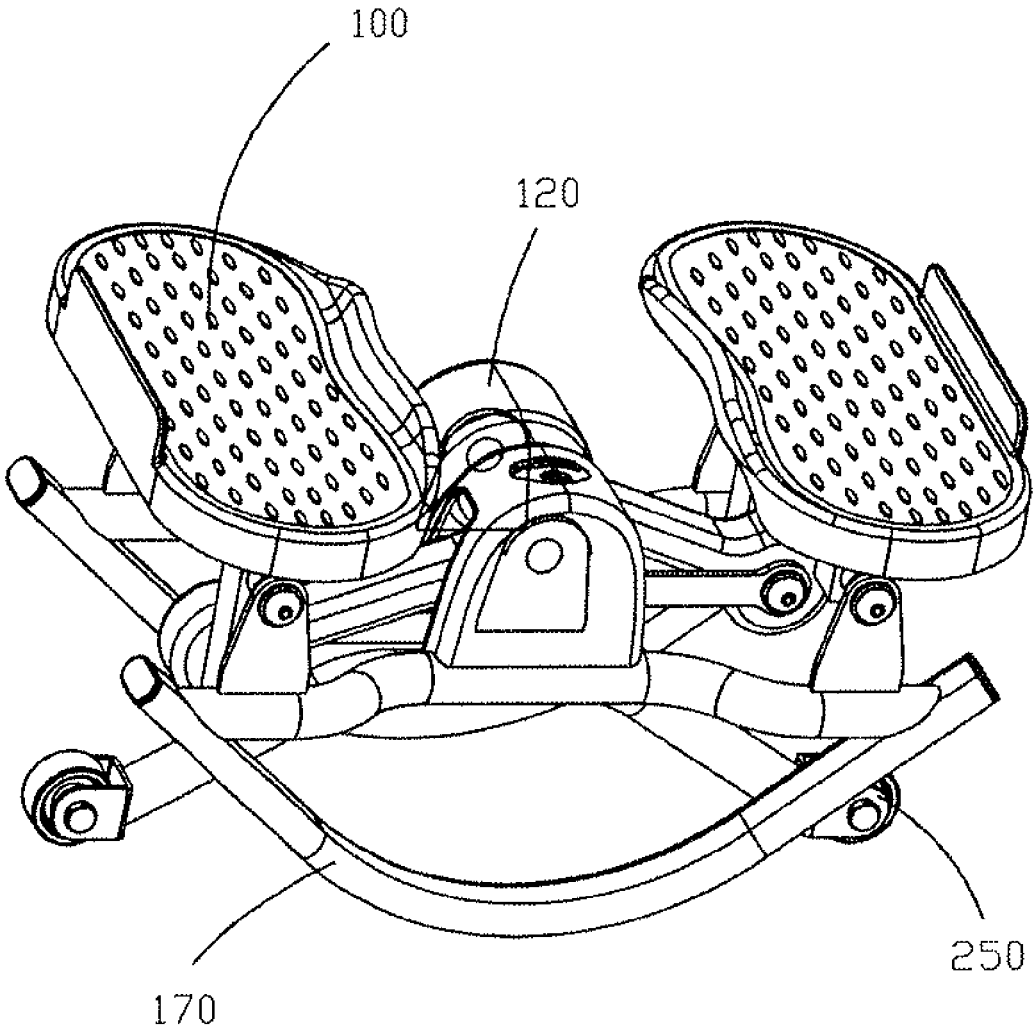
FIG. 3 is an assembled, isometric view of a stepping exerciser in accordance with an alternative embodiment of the present invention.

FIG. 3 shows a stepping exerciser in accordance with another embodiment. The stepping exerciser of this embodiment is similar to that of the above-mentioned embodiment. However, the L-shaped pipes 260, the handles 280 are left out to make the stepping exerciser simple. This stepping exerciser of this embodiment has substantially same stepping functions as that of the above-mentioned embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stepping exerciser comprising:

a bracket and a rack;

a pair of pedal holders rotatably mounted to an upper portion of the bracket;

a pair of pedals;

a beam pivoting the bracket to an upper portion of the rack;

a pair of connecting levers, wherein a first end of each of the connecting levers is rotatably connected to a corresponding pedal holder, a second end of each of the connecting levers is rotatably connected to the rack;

a pair of wheels rotatably installed on the rack; and at least a pair of flexible pulling members, each of the flexible pulling members pivoted at one end thereof to the beam and at the other end thereof to a lower portion of a corresponding pedal holder for enhancing movement resistance to the corresponding pedal.

2. The stepping exerciser as claimed in claim 1, wherein the rack is V-shaped and comprises a pair of supporting legs at a lower portion thereof, and wherein the wheels are mounted to distal ends of the supporting legs respectively.

3. The stepping exerciser as claimed in claim 1, further comprising a pair of handles and a pair of L-shaped pipes, wherein the L-shaped pipes are positioned to the pedal holders and the handles are positioned in the L-shaped pipes.

4. The stepping exerciser as claimed in claim 3, wherein each L-shaped pipe defines a plurality of locating holes and each handle forms a locating portion adjacent a bottom end thereof, and wherein the locating portions are selectively locked at the locating holes by copper pins to allow a height of each handle to be adjustable in accordance with different users.

5. The stepping exerciser as claimed in claim 1, further comprising a carpet for supporting the rack thereon.

6. The stepping exerciser as claimed in claim 1, further comprising a shell and a counter.

7. The stepping exerciser as claimed in claim 1, wherein the bracket comprises two plates at a center thereof, each plate defines an installing hole for installing the beam between the plates.

8. The stepping exerciser as claimed in claim 1, further comprising a pair of rotating rods, wherein the bracket comprises two groups of tabs respectively adjacent opposite ends thereof, each tab defines a through hole therein, and wherein the pedal holder each comprise a mount for supporting the corresponding pedal, a connecting portion extending downwardly form the mount, a hollow tube extending through the connecting portion, and wherein the rotating rods respectively pass through the through holes of the plates and the hollow tubes of the pedal holders for rotatably installing the pedal holders to the bracket.

9. The stepping exerciser as claimed in claim 8, wherein each group of tabs is connected by a limiting member at an inner side thereof for limiting the rotation range of the corresponding pedal holder.

10. The stepping exerciser as claimed in claim 8, wherein an positioning nut extends perpendicularly and inwardly from the connecting portion of each pedal holder, and wherein one end of each connecting lever is rotatably connected to the positioning nut, and the other end of the connecting lever is rotatably connected to one end of a double end nut of the rack, and wherein the flexible pulling members rotatably connected to the positioning nuts to be installed to the pedal holders.

11. The stepping exerciser as claimed in claim 1, wherein the pedals are capable of rotating inwardly and outwardly.

* * * * *